US006969036B2

(12) United States Patent
Magnusson

(10) Patent No.: US 6,969,036 B2
(45) Date of Patent: Nov. 29, 2005

(54) MOUNTING BRACKET FOR WIRE SHELF SYSTEM

(75) Inventor: Reine Magnusson, Vastervik (SE)

(73) Assignee: Elfa International AB, (SE)

( * ) Notice: Subject to any disclaimer, the term of this patent is extended or adjusted under 35 U.S.C. 154(b) by 0 days.

(21) Appl. No.: 10/381,725

(22) PCT Filed: Sep. 12, 2001

(86) PCT No.: PCT/SE01/01950

§ 371 (c)(1),
(2), (4) Date: Sep. 3, 2003

(87) PCT Pub. No.: WO02/26083

PCT Pub. Date: Apr. 4, 2002

(65) Prior Publication Data

US 2004/0035996 A1 Feb. 26, 2004

(30) Foreign Application Priority Data

Sep. 29, 2000 (SE) ..... 0003516

(51) Int. Cl.[7] ..... B42F 13/00; A47F 5/08
(52) U.S. Cl. ..... 248/339; 211/106; 211/119
(58) Field of Search ..... 248/339, 340, 248/215, 229.26, 214, 249, 302, 303, 304; 211/106, 112, 119, 181.1

(56) References Cited

U.S. PATENT DOCUMENTS 1,176,588 A * 3/1916 Miller et al. ..... 248/250
1,717,156 A * 6/1929 Johansson ..... 248/307
2,606,666 A * 8/1952 Gray ..... 211/113
2,622,834 A 12/1952 Sparring
2,754,974 A * 7/1956 Larson ..... 211/70.6
2,858,266 A * 10/1958 Schneider ..... 204/297.09
3,321,089 A * 5/1967 Krikorian ..... 211/134
3,528,590 A * 9/1970 Nathanson ..... 223/85
4,129,218 A * 12/1978 Koellner ..... 211/116
4,340,144 A * 7/1982 Cousins ..... 211/106.01
D278,576 S * 4/1985 Rivkin et al. ..... D6/317
4,720,069 A 1/1988 Bessinger
4,846,356 A 7/1989 Dubuc
4,869,378 A * 9/1989 Miller ..... 211/94.01
4,984,694 A 1/1991 Magnusson
5,107,996 A * 4/1992 Whittaker ..... 211/116
5,405,026 A * 4/1995 Lee et al. ..... 211/123
5,492,295 A * 2/1996 Remmers ..... 248/251
5,531,416 A * 7/1996 Remmers ..... 248/222.51
5,687,856 A * 11/1997 Kendrena ..... 211/70.6
5,758,851 A * 6/1998 Remmers ..... 248/251

(Continued)

*Primary Examiner*—Anita M. King
(74) *Attorney, Agent, or Firm*—Stites & Harbison PLLC; Marvin Petry

(57) ABSTRACT

A mounting bracket having different types of hooks and similar means suited for hanging of objects and utensils of different kinds at the underside of a wire shelf or wire basket of the type comprising an inner and an outer support wire and at least one intermediate support wire, and a large number of shelf plane wires attached to the upper side of the support wires, and in which the wire shelf or wire basket can be at least slightly bent up at the inner end and/or the outer end thereof, and in which the mounting bracket comprises a bar which is formed with attachment means, by means of which the bar can be secured to the underside of the wire shelf or wire basket in both horizontal and vertical direction by co-operation with the support wires of the wire shelf of basket.

13 Claims, 2 Drawing Sheets

U.S. PATENT DOCUMENTS 5,836,461 A * 11/1998 Kokenge et al. ..... 211/153
5,908,120 A * 6/1999 Yates et al. ..... 211/119
5,921,412 A 7/1999 Merl
6,024,333 A * 2/2000 Raasch et al. ..... 248/247
6,189,847 B1 * 2/2001 Hart ..... 248/220.31
6,227,387 B1 * 5/2001 Rose ..... 211/85.29

* cited by examiner

MOUNTING BRACKET FOR WIRE SHELF SYSTEM

FIELD OF THE INVENTION

The present invention generally relates to a mounting bracket having hanger hooks, and arranged to be mounted at the underside of a wire shelf or a wire basket of the priorly known type which is formed for being mounted on a bracket which in turn is connected to a suspension bar or a wall rail which can be screwed of otherwise secured onto to a wall, and in which the brackets can be mounted at any desired height on the suspension bar or the wall rail.

BACKGROUND OF THE INVENTION

A system comprising a wall rail and support brackets is known since long and it shown, for instance, in the U.S. Pat. No. 2,622,834 (Sparring). Wire shelves are often mounted on such support brackets, for instance wire shelves of the type which is shown in the U.S. Pat. No. 4,984,694 (Sparring). Said wire shelves comprise several support wires extending parallelly to each other and parallelly to the wall against which the suspension bars or wall rails with the brackets are mounted, and a large number of wires forming the shelf plane and attached on top of the support wires transversally to same.

SUMMARY OF THE INVENTION

The present invention relates to a supplementary system for wire shelves of the said type, by means of which it is possible to hang objects underneath the wire shelves, even heavy objects and for use in cellars, in storing places, in garden tool houses, in garages etc. The present supplementary system is especially useful as hanger means in the cases when it is desired to avoid to hang the objects on hooks etc. directly onto the wall, and when it is desired to hang large and heavy objects which do not fit for, and are not suited for being hanged by means of wall hooks. It is of great advantage to be able to use the hang bar systems known from the priorly known patents even for hanging objects in a cellar, in a garage, in tool sheds, in wardrobes and in many other places.

To that end the invention relates to a support bracket having different types of hooks and similar means which are suited for hanging of heavy objects and utensils of different types, like spades, pitchforks, rakes, tires, hoses, wheels, cycles and many other objects.

According to the invention the mounting bracket comprises a bar, which, at the upper side thereof, is formed with connection means by means of which the bar can be secured both in the horizontal direction and in the vertical direction underneath a wire shelf of the type comprising an outer and an inner support wire and at least one intermediate support wire extending between said inner and outer support wires, and a large number of shelf plane wires attached on top of said support wires and extending at right angle to said support wires and preferably at right angle to the wall against which the suspension bar or the wall rail with the brackets and the wire shelves is mounted.

It is important that the mounting bracket is safely mounted at the underside of the wire shelf, so that it can not unintentionally become released therefrom. To that end the mounting bracket is formed with an inner and an outer recess, which recesses are adapted to fit the inner and outer support wires and which, when the mounting bracket is mounted, prevents the mounting bracket from being displaced inwardly or outwardly. The mounting bracket is further formed with one or more locking hooks extending at an angle downwards-rearwards, or eventually downwards-forwards, and which are arranged to lockingly engage one or more of the intermediate support wires. The locking hooks are adapted to secure the mounting bracket in the vertical direction, so that it can not fall down from the wire shelf.

For a safe locking of the mounting bracket to the underside of the wire shelf both in horizontal and in vertical direction the distance between the recesses at the ends of the mounting bracket is the same as the distance between the inner and the outer support wires, and also the distance between the inner and the outer support wires and the inner covering parts of the locking hooks is the same as the distance between the inner and the outer support wires, respectively, and the intermediate support wire or wires of the wire shelf.

For making it possible to connect the mounting bracket against the support wires of the wire shelf said wire shelf must necessarily be capable of being bent slightly upwards so that both the inner and outer support wire(s) can be brought to snap into the recesses therefore and the intermediate support wire or wires can be brought to lockingly engage the locking hooks, respectively. The method for mounting of the mounting bracket will be described more in detail in connection to FIGS. 4, 5 and 6.

BRIEF DESCRIPTION OF THE DRAWINGS

Now the invention is to be described more in detail with reference to the accompanying drawings, in which.

DETAILED DESCRIPTION OF THE PREFERRED EMBODIMENTS

Figure 1:
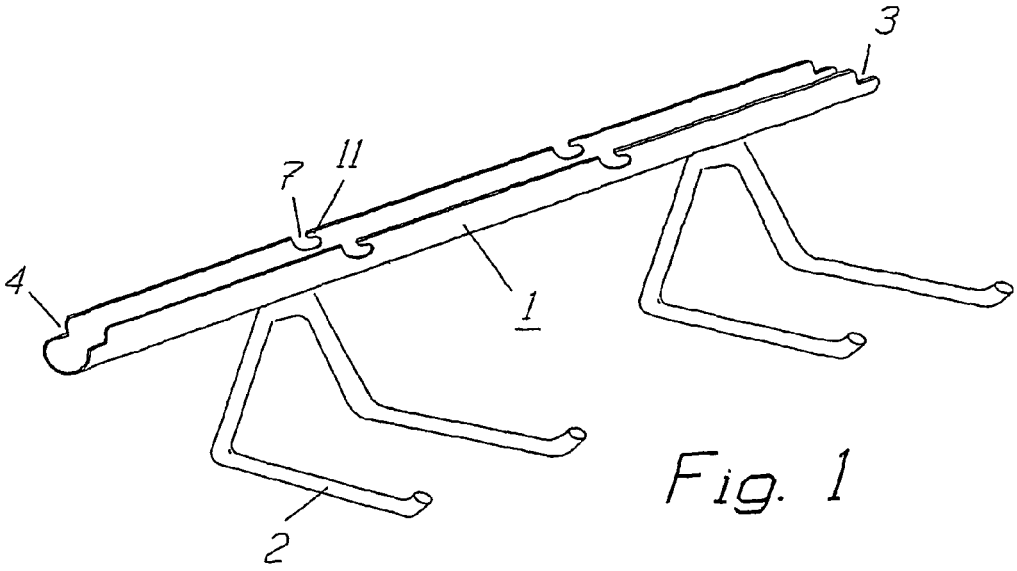
FIGS. 1, 2 and 3 are perspective views of mounting brackets according to the invention disclosing three different types of hanger hooks.
Figure 2:
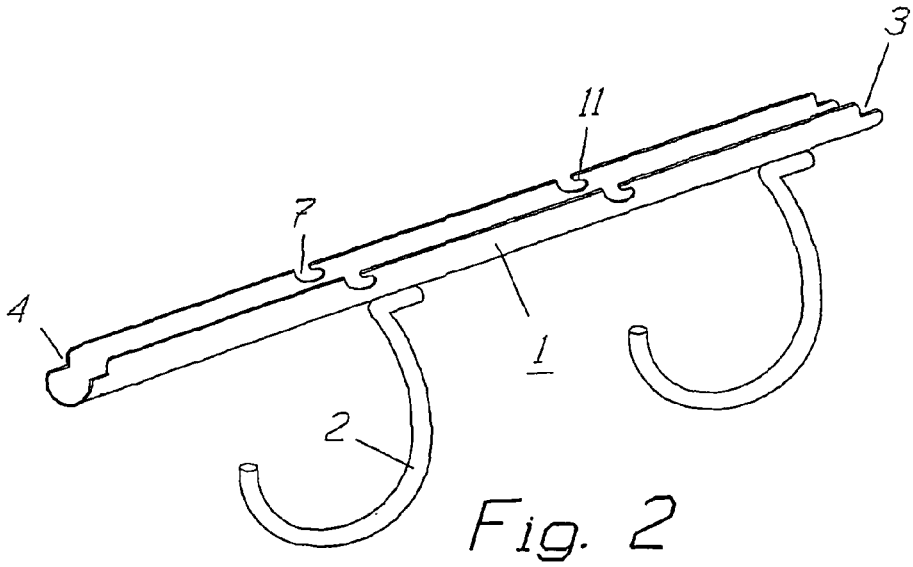
Figure 3:
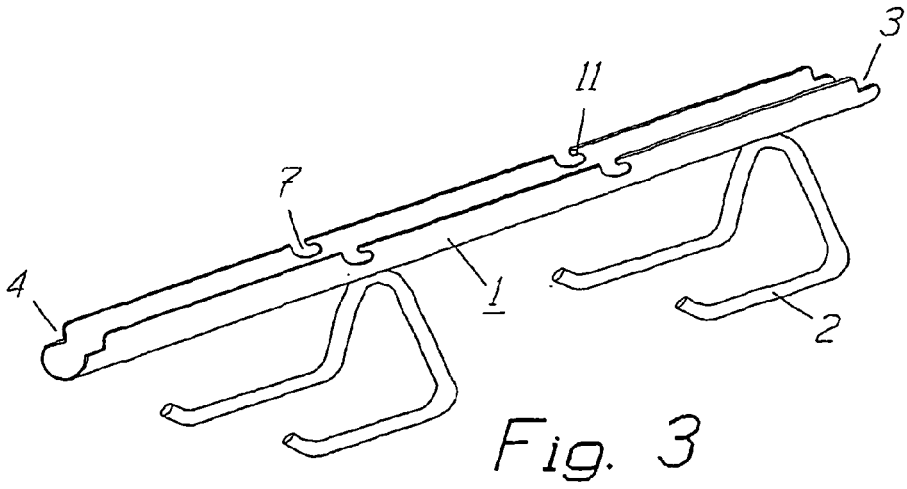

In FIGS. 1, 2 and 3 are illustrated mounting brackets 1 having three different types of hanger hooks 2 which can be used, for instance for hanging of garden tools, of garage utensils, of hand tools, of cycles and all kinds of other heavy objects. A great advantage with the invention is that the objects hanged on the hooks are not in contact with the wall, and that is it consequently possible to hang the objects spaced from each other at predetermined distances from the wall, thus freely spaced from each other.

Figure 4:
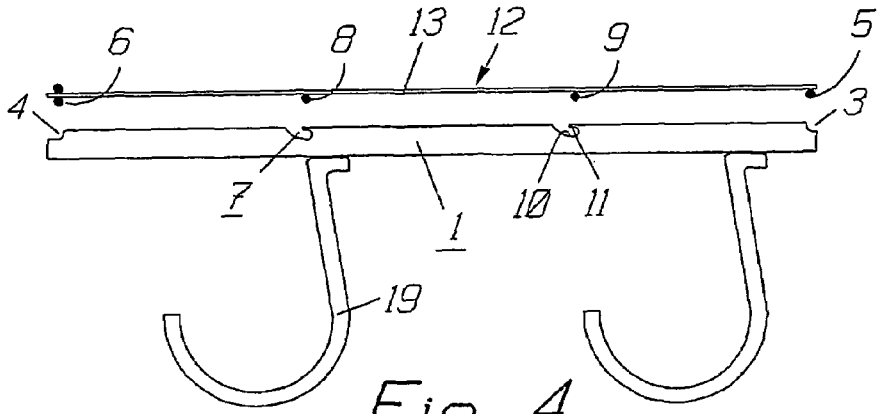
FIGS. 4, 5 and 6 illustrate the method of mounting of the mounting brackets under a wire shelf having a shelf system including a wall rail and several mounting brackets, on which wire shelves are arranged to be mounted on and can be dismounted from, respectively, the mounting brackets.
Figure 5:
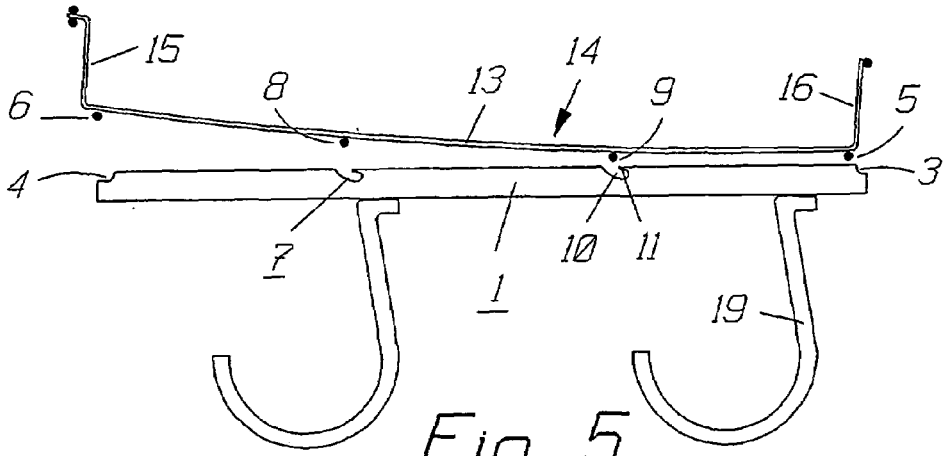

The mounting bracket 1 comprises a bar which is open at the top, for instance a U-shaped, open bar, which at the upper side thereof, at the inner top end and outer top end are formed with chamfered recesses 3 and 4 having a inner curve radius which corresponds to the diameter of the inner and outer support wires 5 and 6 (see FIGS. 4 and 5). The distance between said recesses 3, 4 correspond to the distance between the inner and outer support wires 5 and 6. The recesses are adapted to secure the bracket when mounted on the wire shelf against displacement outwards in the horizontal direction, or eventually also inwards, in relation to the wire shelf.

For securing the mounting bracket against displacement in the vertical direction, in particular against releasing in the direction downwards, said bracket is/are formed with one or more locking hooks 7 which are open in the direction upwards, and which are arranged in the side branches of the U-shaped bar. Said locking hooks 7 are formed as to provide a downwards-inwards, or eventually downwards-outwards extending locking ear 10 which, with one end thereof, provides an inner arc having substantially the same diameter as that of the intermediate locking wire or wires 8, 9 which are to be secured in said locking ear 10. At the upper side of the inner part of the locking ear 10 there is formed an upper projecting tongue 11 which makes it impossible for the mounting bar to become displaced in the direction downwards when mounted on a wire shelf. The distance between the inner end of the locking ear or ears 10 and the recesses 3 and 4 corresponds to the distance between the support wires 5, 6, 8 and 9. Thereby the mounting bar, when mounted, is secured both against displacement in the horizontal direction and against unintentional releasing vertically downwards from the wire shelf.

Figure 6:
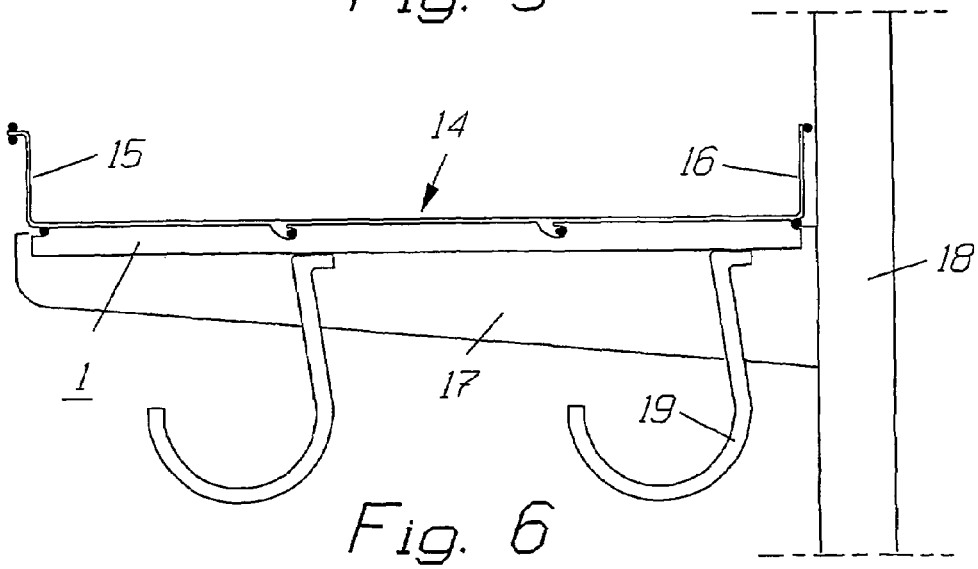

In FIG. 4 is shown a wire shelf 12 comprising inner and outer support wires 5 and 6, intermediate support wires 8 and 9 and a large number of shelf plane wires 13 extending transversally to the support wires 5, 6, 8 and 9 at the upper side thereof. In FIGS. 5 and 6 is shown that the wire shelf may alternatively be formed as a wire basket 14 having front and rear sides 15 and 16 which are bent upwards but which otherwise has the same shape as that of the shelf 12 of FIG. 4.

For making it possible to mount the wire shelf 12 or the wire basket 14, respectively, it is presupposed that said shelf/basket can be bent resiliently slightly upwards at the front and rear ends. It is obvious from FIG. 4 that the support wires 5, 6, 8 and 9 are located straight above the recesses 3 and 4 and above the inner of the locking ears 10. In order to introduce the support wires 5, 6, 8, 9 in their respective positions in the support bracket 1 it is necessary that the wire shelf 12 or the wire basket 14, respectively, can be displaced outwards so that the support wires 8 and 9 come into position for introducing said wires 8, 9 in the locking hooks 7. In this position the shelf 12 can be moved down into locking position only after the shelf is bent slightly upwards as indicated in FIG. 5, whereby the intermediate locking wires 8 and 9 can be moved down into the locking hooks 7, whereas the inner locking wire 5 is in contact with the upper edge of the mounting bracket 1 and the outer locking wire 6 is located in front of/outside its corresponding mounting bracket recess 4. When the intermediate support wires 8 and 9 of the wire shelf 12 or the wire basket 14, after having been bent upwards, slide downwards-inwards, guided by the lower edge of the locking hooks 7 the shelf/basket is automatically moved inwards, and when the support wires 8, 9 have come into position at the bottom of the locking hooks 10 the inner support wire 5, concurrently therewith, slides down into its recess 3 and also the outer support wire 6 enters its position at the curved end of the outer recess 4.

As shown in FIG. 6 the wire shelf 12 or the wire box 14 with the mounting bracket is arranged to be mounted on a known type of support console 17 which is, in turn, hooked onto a suspension bar or a wall rail 18 in any suitable height position.

A releasing of the mounting bracket can be made in the oppositely way, namely in that at least the inner edge or the inner side of the shelf 12 or the basket 14 is raised slightly at the same time as the mounting bracket 1 is moved slightly out from the wall, whereby the inner support wire 5 becomes positioned on the upper surface of the mounting bracket 1 and the intermediate support wires 8, 9 become 9 are located just in front of the openings of the locking hooks 7, whereby the shelf/basket can easily be lifted off the mounting bracket 1.

It should be noted that it is possible to attach the mounting bracket to a wire shelf 12 or a wire basket 14 before the shelf/basket is mounted on its support console 17. By attaching the mounting bracket 1 to the shelf/basket as mentioned above it is possible to mount the shelf 12 with the mounting bracket 1 in an opposite position onto the console 17, that is with the shown hooks 19 with the free ends thereof facing the wall rather than out from the wall as shown in the drawings. Correspondingly the hanger hooks 2 of FIG. 1 will open to the left and the hooks 2 of FIG. 2 will likewise face the wall. In this case the releasing of the mounting bracket 1 is likewise made after the shelf 12 with the mounting bracket 1 has been released from the support console 17.

REFERENCE NUMERALS

1 mounting bracket
2 hanger hook
3 recess (chamfered)
4 recess (chamfered)
5 inner support wire
6 outer support wire
7 locking hook
8 intermediate support wire
9 intermediate support wire
10 locking ear
11 tongue
12 wire shelf
13 shelf plane wire
14 wire basket
15 front side
16 rear side
17 support console
18 wall rail
19 hook

What is claimed is:

1. A mounting bracket having different types of hooks for hanging of objects and utensils of different kinds from the underside of a wire shelf or a wire basket of the type comprising an inner support wire and an outer support wire and at least one intermediate support wire, and a large number of shelf plane wires attached to an upper side of said support wires and extending transversally to said support wires, and in which the wire shelf or basket can be bent at least slightly upwards at the inner end and/or the outer end thereof, said mounting bracket comprising a bar having a "U" shaped cross section with branches formed with securing means for securing the mounting bracket to the underside of the wire shelf both in the horizontal direction and in the vertical direction by co-operation with the support wires of the wire shelf, and wherein the securing means of the mounting bracket comprises recesses at an upper side and at the ends of the mounting bracket, arranged for lockingly engaging the inner and the outer support wires of the wire shelf.

2. A mounting bracket according to claim 1, wherein the recesses at the ends of the mounting bracket are facing out towards the ends of the mounting bracket and with inner ends thereof are arranged on the same mutual distance as the distance between the inner and outer support wires.

3. A support bracket according to claim 1, wherein the recesses at the ends of the mounting bracket have a curved portion adapted to face the shelf and having the same radius as that of the support wires.

4. A mounting bracket according to claim 1, wherein the mounting bracket, at the underside thereof, is formed with hooks or hangers suited for hanging utensils and heavy objects.

5. A mounting bracket according to claim 4, wherein the mounting bracket is arranged for being mounted under the wire shelf with the hooks turned in opposite directions, whereby the mounting bracket is connectable to the wire shelf before a unit consisting of the wire shelf and the mounting bracket is mounted on a shelf console of known type, which is, in turn, connected to a suspension bar or a wall rail of a prior known type.

6. A support bracket having different types of hooks for hanging of objects and utensils of different kinds from the underside of a wire shelf or a wire basket of the type comprising an inner support wire and an outer support wire and at least one intermediate support wire, and a large number of shelf plane wires attached to an upper side of said support wires and extending transversally to said support wires, and in which the wire shelf or basket can be bent at least slightly upwards at the inner end and/or the outer end thereof, said mounting bracket comprising a bar having a "U" shaped cross section with branches formed with securing means for securing the mounting bracket to the underside of the wire shelf both in the horizontal direction and in the vertical direction by co-operation with the support wires of the wire shelf, and wherein the securing means of the mounting bracket comprises several locking hooks provided between the ends of the mounting bracket, and the positions of which are adapted to correspond to the positions of the intermediate support wire or wires.

7. A mounting bracket according to claim 6, wherein the locking hooks are formed as obliquely downwards extending locking ears, into which the intermediate support wires can be forced down thereby securing the mounting bracket to the wire shelf.

8. A mounting bracket according to claim 7, wherein the locking ears are formed as obliquely downward inward or obliquely downward-outward extending bow formed slots ended by a curved portion having the same radius as that of the intermediate support wires, and at an upper side of said curved portion a projecting tongue which prevents a downward displacement of the mounting bracket in relation to the wire shelf.

9. A mounting bracket according to claim 6, wherein the mounting bracket, at the underside thereof, is formed with hooks or hangers suited for hanging utensils and heavy objects.

10. A mounting bracket according to claim 9, wherein the mounting bracket is arranged for being mounted under the wire shelf with the hooks turned in opposite directions, whereby the mounting bracket is connectable to the wire shelf before a unit consisting of wire shelf and mounting bracket is mounted on a shelf console of known type, which is, in turn, connected to a suspension bar or a wall rail of a prior known type.

11. A mounting bracket having different types of hooks for hanging of objects and utensils of different kinds from the underside of a wire shelf or a wire basket of the type comprising an inner support wire and an outer support wire and at least one intermediate support wire, and a large number of shelf plane wires attached to an upper side of said support wires and extending transversally to said support wires, and in which the wire shelf or basket can be bent at least slightly upwards at the inner end and/or the outer end thereof, said mounting bracket comprising a bar having a "U" shaped cross section with branches formed with securing means for securing the mounting bracket to the underside of the wire shelf both in the horizontal direction and in the vertical direction by co-operation with the support wires of the wire shelf, and wherein said securing means comprises locking hooks having locking ears and said mounting bracket is securable to the underside of a wire shelf or a wire basket by bending the wire shelf or the wire basket slightly upwards at least at the inner or outer end thereof so that an inner or outer one of the locking ears is facing the inner or outer end, whereby the intermediate support wires are slidable downwards into and towards the bottom of the locking ears.

12. A mounting bracket according to claim 11 wherein the mounting bracket, at the underside thereof, is formed with hooks or hangers suited for hanging utensils and heavy objects.

13. A mounting bracket according to claim 12, wherein the mounting bracket is arranged for being mounted under a wire shelf with the hooks turned in opposite directions, whereby the mounting bracket is connectable to the wire shelf before a unit consisting of wire shelf and mounting bracket is mounted on a shelf console of known type, which is, in turn, connected to a suspension bar or a wall rail of a prior known type.

* * * * *